US006322942B1

(12) United States Patent
Chou et al.

(10) Patent No.: US 6,322,942 B1
(45) Date of Patent: Nov. 27, 2001

(54) XEROGRAPHIC PHOTORECEPTOR PRIMARILY FORMED BY THE HYDROGENATED AMORPHOUS SILICON MATERIAL AND THE METHOD FOR MANUFACTURING THE SAME

(75) Inventors: Jung-Chuan Chou, Touliu; Hsu-Ying Yang, Kaohsiung; Chau-Yun Jen, Ping Jen, all of (TW)

(73) Assignee: National Science Council of Republic of China, Taipei (TW)

( * ) Notice: Subject to any disclaimer, the term of this patent is extended or adjusted under 35 U.S.C. 154(b) by 0 days.

(21) Appl. No.: 09/558,852

(22) Filed: Apr. 27, 2000

(51) Int. Cl.[7] ..... G03G 5/082
(52) U.S. Cl. ..... 430/59.1; 430/128
(58) Field of Search ..... 430/65, 66, 69, 430/84, 59.1, 128

(56) References Cited

U.S. PATENT DOCUMENTS 4,770,966 * 9/1988 Kazama et al. ..... 430/66
4,885,220 * 12/1989 Kuhman et al. ..... 430/31
5,945,241 * 8/1999 Niino et al. ..... 430/57.4
6,120,955 * 9/2000 Tokutake et al. ..... 430/69

* cited by examiner

*Primary Examiner*—John Goodrow
(74) *Attorney, Agent, or Firm*—Bacon & Thomas

(57) ABSTRACT

A xerographic photoreceptor primarily formed by amorphous silicon material is disclosed, wherein the xerographic photoreccptor is a photosensitive drum used in copying and manufactured by the plasma enhanced low pressure chemical vapor deposition system. Such a drum has a higher resolution, and a longer lifetime. In this structure, an $Al_2O_3$ oxidization layer is grown on an aluminum substrate. Then a n type hydrogenated amorphous silicon blocking layer is grown on the aluminum substrate with $Al_2O_3$ oxidization layer. Then an intrinsic hydrogenated amorphous silicon charge generating transmission layer is grown on the n type hydrogenated amorphous silicon blocking layer. Finally a hydrogenated amorphous carbon surface protecting layer is grown on the intrinsic hydrogenated amorphous silicon charge generation transport layer for forming a xerographic photoreceptor with a multiple layer structure. Not only the manufacturing process is simple, but also a lager area is achieved in preparing a film manufacture and thus, the cost will be reduced.

10 Claims, 5 Drawing Sheets

FIG. 7

| | Without a-C : H layer | With a-C : H layer |
|---|---|---|
| Initial surface potential (VS) (Volt) | 144 (9.6V/$\mu$m) | 540 (36V/$\mu$m) |
| Dark decay time ($t_d$) (sec) | 5 | 6 |
| Photosensitivity ($E_{1/2}$) (lux·sec) | 1.8 | 8 |
| Residue potential (Vr) (Volt) | 10 | 22 |
| Contrast potential ratio (Vs/Vr) | 24.4 | 24.5 |

FIG. 8

| | $Al_2O_3$ | $Al_2O_3$/ p type a-Si : H | $Al_2O_3$/ n type a-Si : H |
|---|---|---|---|
| Surface corona charging potential (Vs) (Volt) | -7KV | +7KV | -7KV |
| Initial surface potential ($t_d$) (sec) | 375 (25V/$\mu$m) | 435 (29V/$\mu$m) | 540 (V/$\mu$m) |
| Dark decay time (sec) | 5 | 8 | 6 |
| Photosensitivity ($E_{1/2}$) (lux·sec) | 6 | 6.2 | 8 |
| Residue potential (Vr) (Vot) | 18 | 30 | 22 |
| Contrast potential ratio (Vs/Vr) | 20.8 | 14.5 | 24.5 |

XEROGRAPHIC PHOTORECEPTOR PRIMARILY FORMED BY THE HYDROGENATED AMORPHOUS SILICON MATERIAL AND THE METHOD FOR MANUFACTURING THE SAME

BACKGROUND OF THE INVENTION

1. Field of the Invention

A xerographic photoreceptor primarily formed by the hydrogenated amorphous silicon material, wherein the xerographic photoreceptor is a photosensitive body manufactured by plasma enhanced low pressure chemical vapor deposition system. Such a xerographic photoreceptor has a higher resolution, and a longer lifetime.

2. Description of the Prior Art

The copy machine and laser printer have been developed and become more and more popular from 1938 due to a first work made by Chester F. Carlson and O. Kornei.

In 1969, R. C. Chittick, etc. disclose a method for manufacturing the hydrogenated amorphous silicon by the glow discharge. Then, the optoelectronic devices made of the hydrogenated amorphous silicon, such as solar cells, photo-transistors, optical detector and xerographic photoreceptor used in copy machine, laser printer and facsimile machine become the primary trend of such a material.

Besides, the photosensitive material used in the photoreceptor of the copy machine, laser printer, and facsimile machine is the most important elements in electrophotography technology. The characteristics of the material are related to the quality of copying. The materials, for example amorphous Se, CdS, and ZnO used in the prior art using the vacuum evaporation method, have a preferred photosensitivity. But they are easily to be worn away, and have a short lifetime. These are significant defects.

From the developing of the hydrogenated amorphous silicon in 1976, people pay attention to the excellent optoelectronic characteristics. Recently, the hydrogenated amorphous silicon applied to a photosensitive photoreceptor has been studied widely. Cannon has firstly developed commercial copy machines using the hydrogenated amorphous silicon photosensitive drum, which are NP-9030 (with semiconductor laser as a light source) and NP-7500 (with a halogen lamp as a light source). Comparing with the conventional photosensitive drums, for example, amorphous Se sad $As_2Se_3$, it has the following advantages:

1. A preferred photoconductivity.
2. A higher dark resistivity.
3. A wider spectrum of photoconductivity.
4. Higher light absorption coefficient.
5. Manufactured by doping, the electrical property can be well controlled.
6. Special homogeneous property so as to be easily deposited on most kinds of substrates.
7. Stronger mechanical strength and elasticity.
8. less poison in using The prior art for the hydrogenated amorphous silicon xerographic photoreceptor can be referred to U.S. Patent Publication U.S. Pat. No. 5,252,418, in the patent, a method for preventing the vagueness of the hydrogenated amorphous silicon xerographic photoreceptor and improving the surface layer structure of the xerographic photoreceptor is disclosed so that it has a longer lifetime.

The prior art of the hydrogenated amorphous silicon xerographic photoreceptor can be referred to U.S. Patent Publication U.S. Pat. No. 4,943,503. In the patent, another structure of the hydrogenated amorphous silicon xerographic photoreceptor is disclosed, wherein a middle layer is deposited between the optical conductive layer and the surface layer. The middle layer is prepared by the amorphous silicon doped with nitrogen atoms or boron atoms.

A prior art for the hydrogenated amorphous silicon xerographic photoreceptor is disclosed in U.S. Patent Publication U.S. Pat. No. 4,913,995. In the patent, a functional separation method was served to prepare a xerographic photoreceptor. Wherein, the transport layer of the amorphous silicon alloy and the middle layer of the hydrogenated amorphous silicon photosensitive layer are charged by positive or negative corona, the xerographic photoreceptor has a high surface potential and lower residual potential.

The prior art for the hydrogenated amorphous silicon xerographic photoreceptor can be referred to U.S. Patent Publication U.S. Pat. No. 48,533,309. In the patent, a sandwich structure (blocking layer/photoconductive layer/surface layer) is disclosed, wherein a gradient concentration method was served to dope the amorphous silicon photoconductive layer.

A prior art for the hydrogenated amorphous silicon xerographic photoreceptor is disclosed in U.S. Patent Publication U.S. Pat. No. 4,804,608, wherein a simple xerographic photoreceptor structure is disclosed. Namely, the conductive substrate photoconductive layer; the photoconductive layer is formed by the amorphous silicon alloy (a-Si(1-m)X(m):Y). Wherein the X is C, N or O, Y is either H or F $0 \leqq m \leqq 1$. The value m is reduced gradually from the surface of the photoconductive layer to the middle part, and is increased gradually from the middle part to the interface of the conductive substrate. Therefore, the xerographic photoreceptor has a preferred charging and photosensitive properties.

A prior art for the hydrogenated amorphous silicon xerographic photoreceptor is disclosed in U.S. Patent Publication U.S. Pat. No. 4,804,605. The patent discloses a xerographic photoreceptor structure with the superlattice. The structure is primarily formed by conductive substrate/blocking layer/photoconductive layer/surface layer. The photoconductive layer has the superlattice structure formed by alternatively stacked hydrogenated amorphous silicon and microcrystal hydrogenated silicon carbide. Both is formed as a potential well so that light is illuminated, a large amount of photo-generation carriers will be generated. And by transport effect, the photo-generation carriers will pass through the blocking layer.

A prior art for the hydrogenated amorphous silicon xerographic photoreceptor is disclosed in U.S. Patent Publication U.S. Pat. No. 4,732,833. In the patent, by mixing the amorphous silicon and superlattice microcrystal silicon, a photoconductive layer of the xerographic photoreceptor is prepared. The whole xerographic photoreceptor is aluminum/amorphous silicon carbide/amorphous silicon (superlattice microcrystal silicon and amorphous silicon).

A prior for the hydrogenated amorphous silicon xerographic photoreceptor is disclosed in U.S. Patent Publication U.S. Pat. No. 4,687,724. In the patent, another steady xerographic photoreceptor with high photosensitivity is disclosed. Namely, the material of the xerographic photoreceptor is amorphous silicon doped by nitrogen, hydrogen and fluorine, and the quality of copying is not be reduced with the operation increasing.

A prior art for the hydrogenated amorphous silicon xerographic photoreceptor is disclosed in U.S. Patent Publication U.S. Pat. No. 4,664,999. In the patent, a layer of amorphous carbon is deposited on the amorphous silicon.

A prior art for the hydrogenated amorphous silicon xerographic photoreceptor is disclosed in U.S. Patent Publication U.S. Pat. No. 4,533,564. In the patent, a method of the electrophotographic photoreceptor is disclosed. The photosensitive structure is approximately formed by a conductive substrate/blocking layer/hydrogenated amorphous silicon (P)/surface protecting layer.

A prior art for the hydrogenated amorphous silicon xerographic photoreceptor is disclosed in U.S. Patent Publication U.S. Pat. No. 4,532,196. In the patent, a plasma enhanced chemical vapor deposition technology was served serves to prepare an amorphous silicon xerographic photoreceptor. The xerographic photoreceptor is primarily formed by many kinds of doped amorphous silicon, the material compositions include $SiH_4$,$B_2H_6$, $N_2$ and $PH_3$. The xerographic photoreceptor has good photosensitivity, longer lifetime and without causing hurt of health for user.

A prior art for the hydrogenated amorphous silicon xerographic photoreceptor is disclosed in U.S. Patent Publication U.S. Pat. No. 4,513,073. In the patent, a photoconductive device formed by a photosersitive layer, one or more blocking layer, which the space charge layer is produced for increasing the acceptance voltage of the photoconductive device (initial surface potential).

Thus, the aforesaid prior arts disclose different methods for preparing the hydrogenated amorphous silicon xerographic photoreceptor. While in the present invention, a plasma enhanced chemical vapor deposition (PE-LPCVD) system was be served to deposit to a multiple layer inorganic xerographic photoreceptor which is photosensitive in visible light and the lifetime of the xerographic photoreceptor is prolonged.

Isamu Shimizu, etc. describe the technology of preparing the hydrogenated amorphous silicon xerographic photoreceptor is difficult. But this difficult is resolved until after the glow discharge method is applied. However, according to L. B. Schein in Electrophotography and Development Physics, 2nd Edition, McGraw-Hill, New York, 1992, discloses the current hydrogenated amorphous silicon xerographic photoreceptor having the thickness of several tens of micrometer (>20 $\mu$m). Thus, the initial surface potential must be as high as 400V for developing. Therefore, the cost and manufacturing technology is the primarily consideration.

Besides, according to J. Mort and F. Janced in Plasma Deposited Thin Films, Chap. 7, pp.187–204, CRC Press, Inc., Florida, 1986, describes that since the thickness of xerographic photoreceptor the is larger than 20 $\mu$m, thus the accepting ability of the surface charge is affected and limited by the substrate and the surface carrier effect carrier. In the condition that carrier injection to the substrate, a blocking layer can be grown between the substrate and the xerographic photoreceptor. The material can be selected as $Si_3N_4$, $SiO_2$, P type hydrogenated amorphous silicon (200 ppm Boron, ~0.3 $\mu$m). Once the thickness of the xerographic photoreceptor is larger than 20 $\mu$m. The conductivity of the hydrogenated amorphous silicon xerographic photoreceptor becomes more and more important and is limited. Moreover, no matter what kinds of materials used in the xerographic photoreceptor, the accepting ability of the surface charge thereof must be in the range of 20~30V/$\mu$m for conforming the requirement of a xerographic photoreceptor.

A preferred xerographic photoreceptor must meet the following characteristics:

(1) High surface charge accepting ability.

(2) Preferred surface insulation.

(3) ILow dark decay.

(4) Quick light decay.

(5) High photosensitivity.

(6) Low residual potential.

(7) Long lifetime.

Therefore for a hydrogenated amorphous silicon xerographic photoreceptor, other then a structural design of function separation, the preparing technology and manufacturing cost must be further considered.

SUMMARY OF THE INVENTION

Accordingly, the primary object of the present invention is to provide a xerographic photoreceptor primarily formed by the hydrogenated amorphous silicon material and the method for manufacturing the same. A function separation concept is served to design a xerographic photoreceptor, and PE-LPCVD method is served to form a hydrogenated amorphous silicon xerographic photoreceptor for increasing photosensitivity and resolution, and the lifetime of the xerographic photoreceptor is also long. The present invention has a quick light response, preferred surface insulation, high resolution, long lifetime and no pollution and no poison without causing a secondary environmental pollution.

A xerographic photoreceptor primarily formed by the hydrogenated amorphous silicon material, wherein the xerographic photoreceptor is a photosensitive body in copy manufactured by plasma enhanced low pressure chemical vapor deposition system, wherein a conductive aluminum substrate is grown with a $Al_2O_3$ oxidation layer, a n type hydrogenated amorphous silicon as charge blocking layer, an intrinsic hydrogenated amorphous silicon as charge generation transport layer, an intrinsic hydrogenated amorphous carbon as the surface protecting layer, thus the xerographic photoreceptor has high photosensitivity and a long lifetime; the method for manufacturing the xerographic photoreceptor comprising the following steps:

a. placing the aluminum substrate into a furnace, baking the aluminum substrate under a temperature of 90~95° C. by a thermal oxidation method, thus the aluminum substrate is grown with the $Al_2O_3$ oxidation layer (20~30 Å);

b. placing the aluminum substrate with the $Al_2O_3$ oxidation layer into a gas deposition system, filling mixed gas ($SiH_4/H_2$=10%, 100 sccm; $pH_3/H_2$=3%, 10 sccm) into the system with the radio frequency power being set at 30 W. The temperature of the substrate is set at 150° C., the deposition pressure is set as 0.75 Torr for growing a n type hydrogenated amorphous silicon blocking material (300~400 Å) on the aluminum substrate with the $Al_2O_3$ oxidation layer;.

c. placing the n type hydrogenated amorphous silicon blocking layer on the aluminum substrate with the $Al_2O_3$ oxidation layer into a gas deposition system, and filling into mixed gases ($SiH_4/H_2$=10%, 150 sccm) with a radio frequency power being set at 30 W. The temperature of the substrate is set at 150° C., the deposition pressure is set at 2 Torr with a deposition time of 7 hours growing for growing an intrinsic hydrogenated amorphous silicon charge generation transport layer (15~16 $\mu$m) on the n type hydrogenated amorphous silicon blocking layer on the aluminum substrate with the $Al_2O_3$ oxidation layer;

d. placing the intrinsic hydrogenated amorphous silicon charge generation transport layer on the aluminum substrate with the $Al_2O_3$ oxidation layer into the gas deposition system, and then filling mixed gas ($Si_4/H_2$= 30%, 100 sccm) with a radio frequency power being set at 40 W. The temperature of the substrate is set at 25°

C., the deposition pressure is set at 0.8 Torr with a deposition time of 20 minutes for growing a hydrogenated carbon surface protecting layer (300~400 Å) on the aluminum substrate with the intrinsic hydrogenated amorphous silicon charge generation transport layer.

BRIEF DESCRIPTION OF THE DRAWINGS

The drawings disclose an illustrative embodiment of the present invention which serves to exemplify the various advantages and objects hereof, and are as follows:

FIG. 7 shows the comparisons of the optoelectronic parameters in the xerographic photoreceptor with or without the hydrogenated amorphous carbon surface protecting layer primarily formed by the hydrogenated amorphous silicon material and the method for manufacturing the same according to the present invention.

FIG. 8 shows the comparison of the optoelectronie parameters in the xerographic photoreceptor for the three kinds of the blocking layer primarily formed by the hydrogenated amorphous silicon material and the method for manufacturing the same according to the present invention.

DETAILED DESCRIPTION OF THE PREFERRED EMBODIMENT

Figure 1:
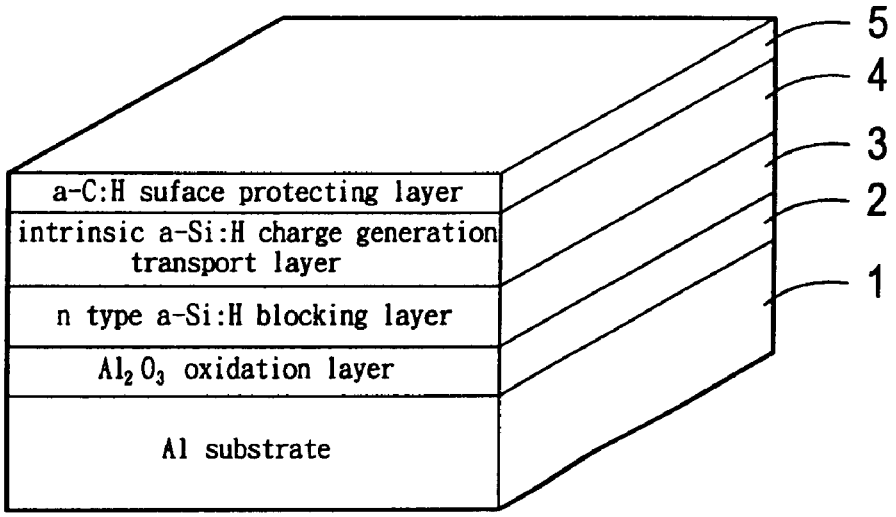
FIG. 1 is a schematic view showing the xerographic photoreceptor primarily formed by the hydrogenated amorphous silicon material and the method for manufacturing the same according to the present invention.

The present invention relates to a xerographic photoreceptor primarily formed by the hydrogenated amorphons silicon material and the method of manufacturing the same. It is a multilayer xerographic photoreceptor. The materials to be manufactured are deposited sequentially on the aluminum substrate of No. 6006 for being as a substrate of the xerographic photoreceptor. The detail manufacturing processes are:

1. Polishing the aluminum substrate of No. 6006.
2. Washing the aluminum substrate by large amount of deionized water for removing the particles and dusts on the surface of the aluminum substrate.
3. Placing the aluminum substrate in a ultrasonic oscillator filling with the acetone solution for oscillation so as to remove the oil grease and impurities on the surface of the aluminum substrate.
4. Taking out the aluminum substrate and then washing the aluminum substrate by large amount of deionized water, and drying the aluminum substrate, then placing the aluminum substrate into a ultrasonic oscillator filling with the alcohol solution for oscillation for removing the acetone solution remained on the aluminum substrate.
5. Taking out the aluminum substrate and then washing by large amount of deionized water, and then drying the aluminum substrate.
6. Placing the washed aluminum substrate into a furnace for baking through 45 minutes by thermal oxidation method. The baking temperature is controlled with the range of 90~95° C. so as to grow the $Al_2O_3$ oxidation layer with a thickness of 20 to 30 Å for being as a blocking layer of the xerographic photoreceptor.
7. Taking out the aluminum substrate, placing into a reaction chamber of the plasma enhanced low pressure chemical vapor deposition system for vacuuming to 5~8×10 Torr.
8. Filling mixing gases ($SiH_4/H_2$=10% , 100 sccm; $PH_3/H_2$=3%, 10 sccm), wherein the radio frequency power is set at 30 W, temperature of the substrate is set at 150° C., deposition pressure is set at 0.75 Torr with a deposition time of 5 minutes for preparing a 400 Å n type hydrogenated amorphous silicon blocking layer of the xerographic photoreceptor.
9. Taking out the aluminum substrate, cleaning the reaction chamber, and repeating step 7.
10. Refilling reaction gas ($SiH_4/H_2$=($SiH_4/H_2$=10% , 150 sccm) whrein the radio frequency power is set at 30 W; temperature of the substrate is set at 150° C., deposition pressure is set at 2 Torr with a deposition time of 7 hours for preparing a 150 $\mu$m intrinsic hydrogenated amorphous silicon photoconductive layer of the xerographic photoreceptor.
11. Taking out aluminum substrate, cleaning the reaction chamber and repeating the step 7.
12. Filling reaction gas ($CH_4/H_2$=30% , 100 sccm). The radio frequency power is set at 40 W, the temperature of the substrate is set at 25° C., the deposition pressure is set at 0.8 Torr with a deposition time of 20 minutes for preparing a 300 Å hydrogenated amorphous carbon surface protecting layer of the xerographic photoreceptor.
13. In order to improve the application of the present invention, referring to FIG. 1, other than performing a manufacturing process of semiconductor, a novel photosensitive xerographic photoreceptor structure is adapted. The $Al_2O_3$ oxidation layer 2 is firstly grown on the aluminum substrate 1 with a thickness of 20~30 Å, and then it is further formed as a-ntype hydrogenated amorphous silicon blocking layer 3 with a thickness of 300~400 Å, which is grown on the aluminum substrate of $Al_2O_3$, then on the n type hydrogenated amorphous silicon, a charge generation transport layer 4 is grown with an intrinsic hydrogenated amorphous silicon having a thickness of 15~16 μm. Finally, a hydrogenated amorphous carbon surface protecting layer 5 with a thickness of 300~400 Å. The way of the hydrogenated amorphous carbon manufacture as a surface protecting layer not only the light absorption of the hydrogenated amorphous silicon xerographic photoreceptor is not affected, but also the amorphous silicon xerographic photoreceptor will not be affected due to environmental wetness and not be ground by external mechanical force.

Figure 2:
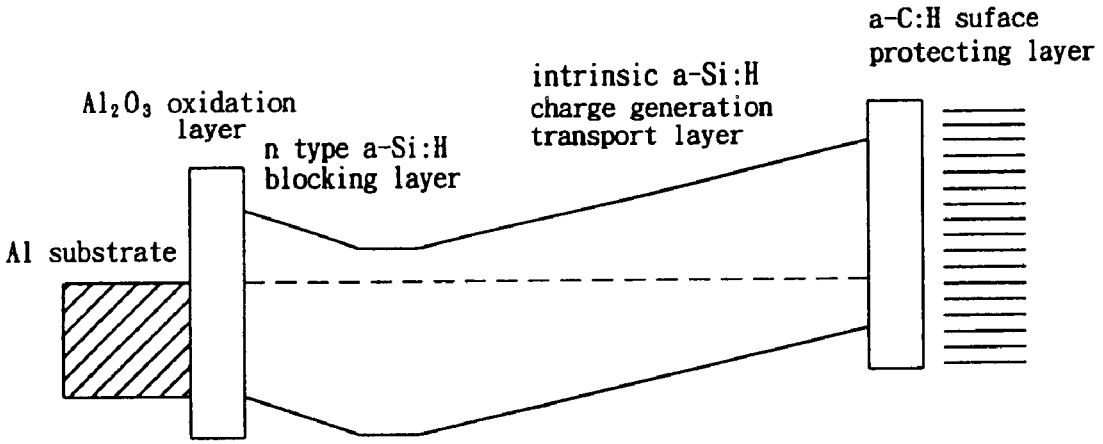
FIG. 2 is an energy band schematic view of the xerographic photoreceptor primarily formed by the hydrogenated amorphous silicon material and the method for manufacturing the same according to the present invention.

Referring to FIG. 2, an energy band diagram of the xerographic photoreceptor device primarily formed by the hydrogenated amorphous silicon material and the method for manufacturing the same is illustrated. Since a potential barrier is formed in the interface of the n type hydrogenated amorphous silicon blocking layer and the intrinsic hydrogenated amorphous silicon charge generation. As a transport layer negative corona is charged to the xerographic photoreceptor, the holes from the substrate can be isolated effectively in order to prevent that the holes to move to the surface so to be neutralized with the negative electrons. This function likes a diode. Thus, the surface charges can be retained in a long time and dark decay time increases.

Figure 3:
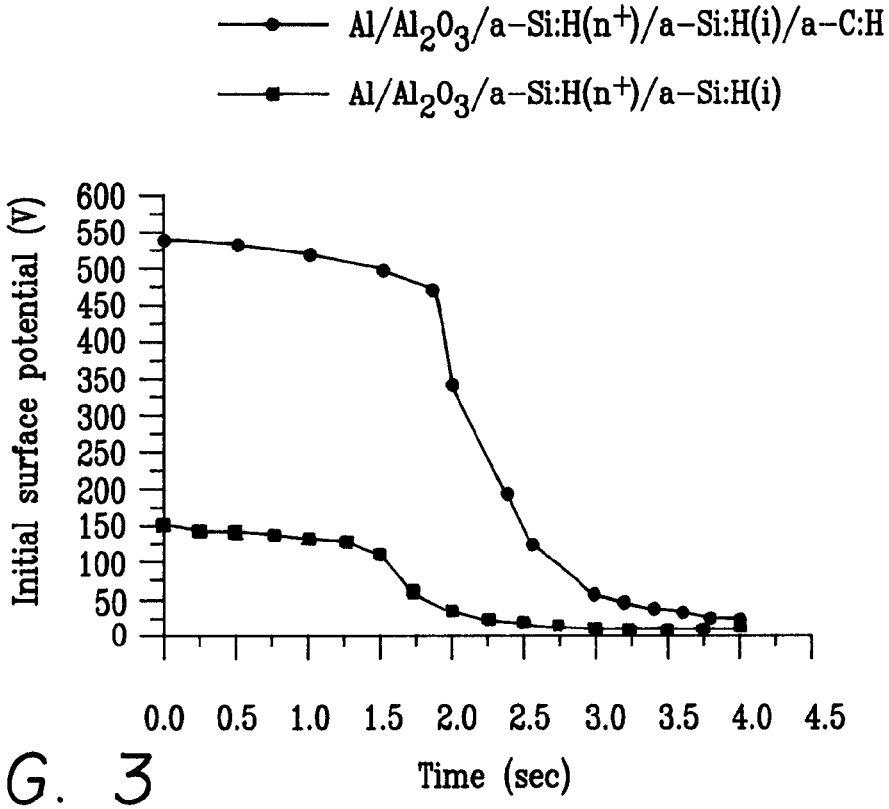
FIG. 3 shows that the photo-induced discharge curves (PIDC) of the xerographic photoreceptor primarily formed by the hydrogenated amorphous silicon material with or withont the hydrogenated amorphous carbon surface protecting layer and the method for manufacturing the same according to the present invention.

With reference to FIG. 3 and Table 1, from the comparison of FIG. 3 and Table 1, it is appreciated that the hydrogenated amorphous silicon xerographic photoreceptor covered by a hydrogenated amorphous carbon surface layer not only has a function of protection, and the lifetime of the xerographic photoreceptor is prolonged. Besides, the initial surface potential and the contrast potential ratio can be increased effectively. Therefore, the resolution of copy is also increased.

Figure 4:
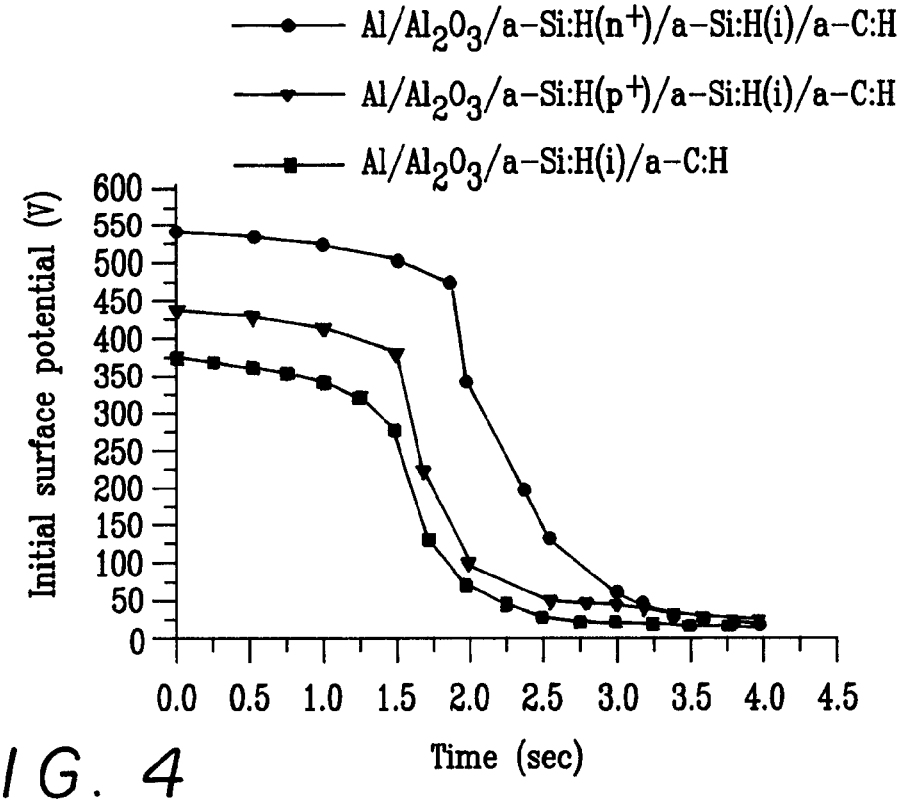
FIG. 4 shows that for the three different type blocking layers, the photo-induced discharge curves of the xerographic photoreceptor primarily formed by the hydrogenated amorphous silicon material and the method for manufacturing the same according to the present invention.

With reference to FIG. 4 and table 2, it is appreciated that the n type hydrogenated amorphous silicon as the blocking layer will further improve the optoelectric property of the xerographic photoreceptor then other blocking layers.

Figure 5:
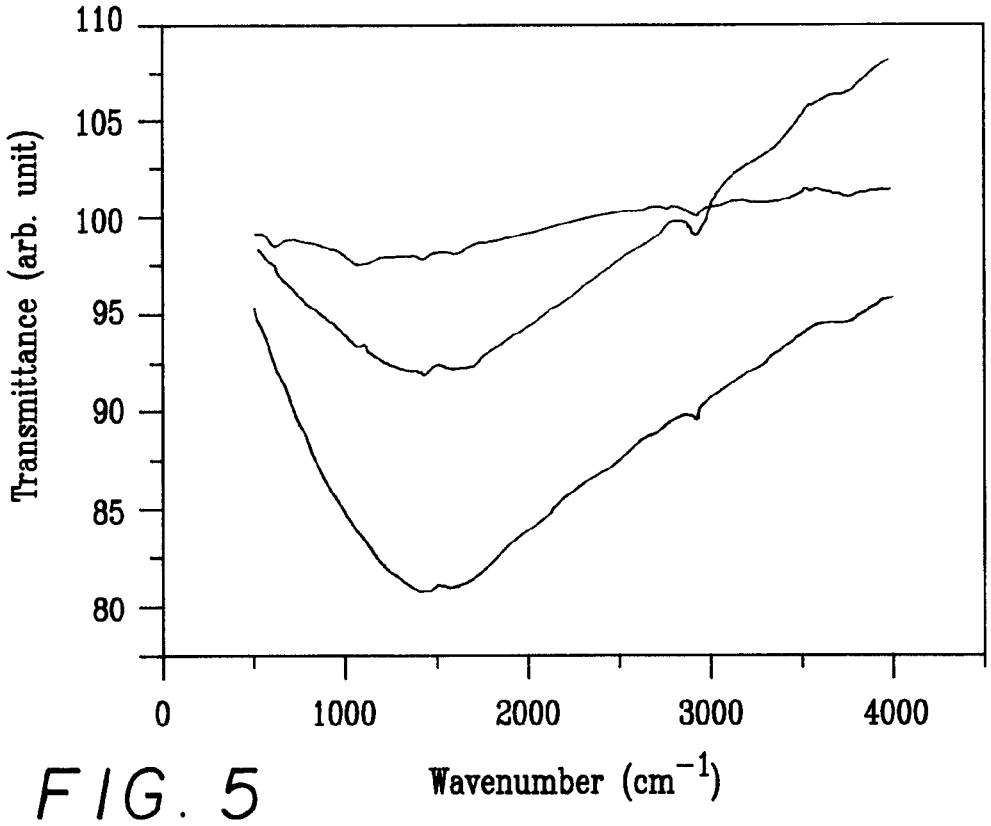
FIG. 5 shows that the Fourier transform infrared spectrum of different thickness for the hydrogenated amorphous silicon film in the xerographic photoreceptor primarily formed by the hydrogenated amorphous silicon material and the method for manufacturing the same according to the present invention.

With reference to FIG. 5, the Fourier transform infrared spectrum of the hydrogenated amorphous silicon films with different thickness are illustrated. Since the thickness of the surface protecting layer of a xerographic photoreceptor is confined. Otherwise, if the surface protection layer is too thicker, the residual potential will increase. Therefore, after a series of experiments, in the present invention, it is found that as the thickness of the hydrogenated amorphous carbon surface protecting layer is 300 Å, the transmission ratio is preferred so that the hydrogenated amorphous silicon xerographic photoreceptor may absorb light effectively.

Figure 6A:
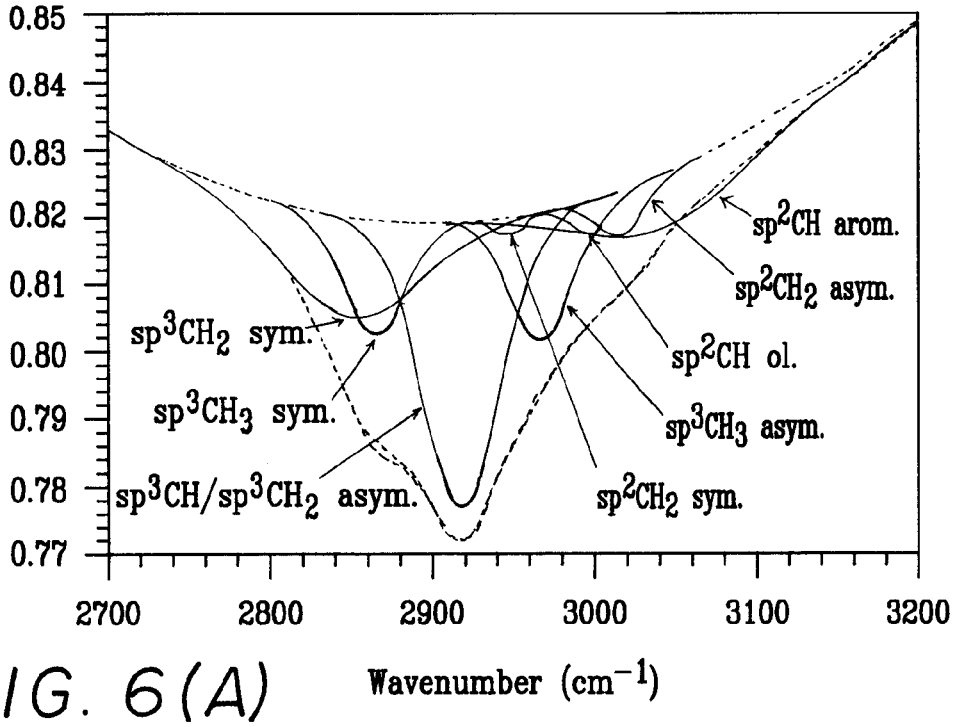
FIG. 6A is the Fourier transform infrared spectrum of the hydrogenated acorphous carbon.
Figure 6B:
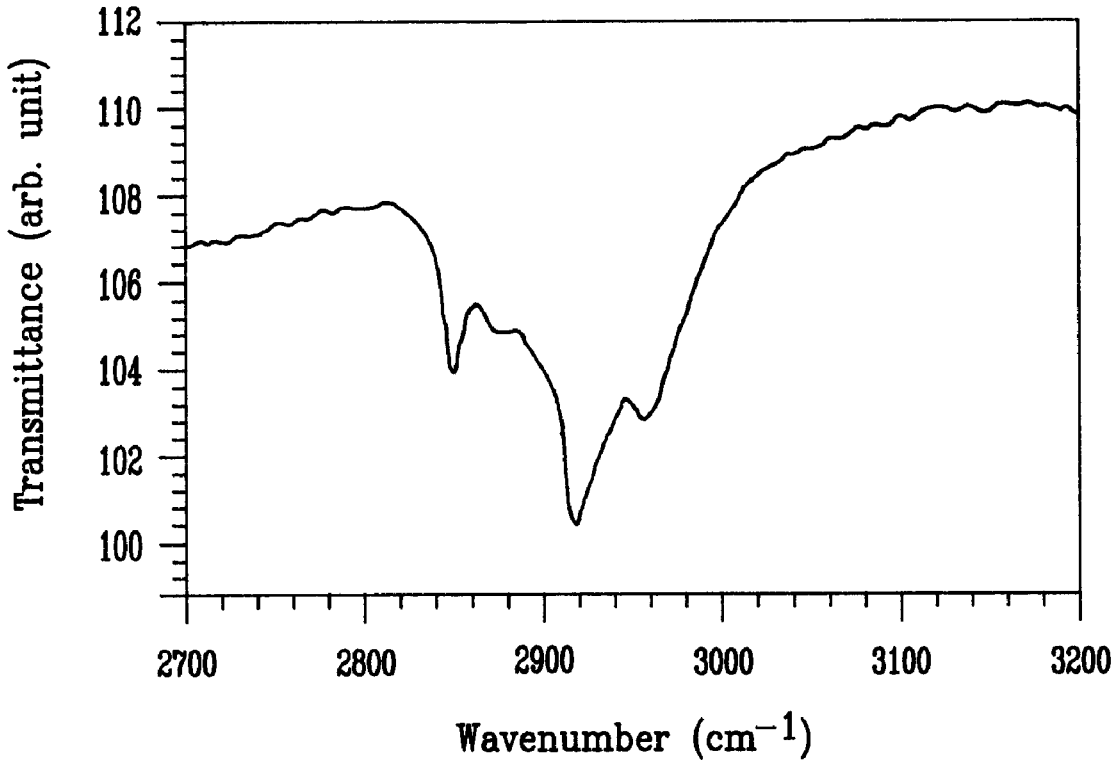
FIG. 6B is the Fourier transform infrared spectrum of the hydrogenated amorphous carbon in the xerographic photoreceptor primarily formed by the hydrogenated amorphous silicon material and the method for manufacturing the same according to the present invention.

With reference to FIGS. 6(A) and 6(B), the Fourier transfrom infrared spectrum of a standard hydrogenated amorphous silicon film and the hydrogenated amorphous silicon film of the present invention are illustrated. From contrasting the two figure, the characteristics of the hydrogenated amorphous silicon film according to the present invention are almost identical to that of standard one. In the wavenumber of 2920 $cm^{-1}$, both have tetrahedral structures of the $sp^3$ bonding.

Comparing the xerographic photoreceptor of the hydrogenated amorphous silicon material of the present invention and the method for manufacturing the same with that of prior art, the present invention has the following advantages:

1. In the present invention, the hydrogenated amorphous silicon xerographic photoreceptor is manufactured by a plasma enhanced low pressure chemical vapor deposition method causes that the xerographic photoreceptor has a preferred photosensitivity and resolution.
2. In the present invention, a gas deposition system serves to prepare a multiple layer xerographic photoreceptor, thus, it has a quick response, a high surface insulation, a high resolution, a long lifetime, and other advantages.
3. The materials used, such as the hydrogenated amorphous silicon film and hydrogenated amorphous carbon film, are not poisonous, no pollution is induced as it is deserted.

Many changes and modifications in the above described embodiment of the invention can, of course, be carried out without departing from the scope thereof. Accordingly to promote the progress in science and the useful arts, the invention is disclosed and is intended to be limited only by the scope of the appended claims.

What is claimed is:

1. A xerographic photoreceptor primarily formed by the hydrogenated amorphous silicon material, wherein the xerographic photoreceptor is photosensitive body used in copying and manufactured by a plasma enhanced low pressure chemical vapor deposition system (PE-LPCVD), wherein a conductive aluminum substrate is grown with a $Al_2O_3$ oxidation layer, a n type hydrogenated amorphous silicon charge blocking layer, a hydrogenated intrinsic amorphous silicon layer charge generation transport layer and hydrogenated amorphous carbon surface protecting layer, thus the xerographic photoreceptor has a high photosensitivity and a long lifetime; method for manufacturing the xerographic photoreceptor comprising the steps of:

a. placing the aluminum substrate into a furnace, baking the aluminum substrate under a temperature of 90~95° C. by thermal oxidation method, thus the aluminum substrate is grown as an $Al_2O_3$ oxidation layer;

b. placing the aluminum substrate into a gas deposition system, filling gas into the system, the radio frequency power being set at 30 W, the temperature of the substrate being set at 150° C., the deposition pressure being set at 0.75 Torr for growing a n type hydrogenated amorphous silicon blocking layer on the aluminum substrate with an $Al_2O_3$ oxidation layer;

c. placing the n type hydrogenated amorphous silicon blocking layer into a gas deposition system, and filling into mixing gases with a radio frequency power being set at 30 W, the temperature of the substrate being set at 150° C., the deposit pressure being set at 2 Torr for growing an intrinsic hydrogenated amorphous silicon charge generation transport layer on the n type hydrogenated amorphous silicon blocking layer on the aluminum substrate with an $Al_2O_3$ oxidation layer;

d. placing the intrinsic hydrogenated amorphous silicon charge generation transport layer into the gas deposition system, and then filling mixing gas with a radio frequency power being set at 40 W, the temperature of the substrate being set at 25° C., the deposition pressure being set at 0.8 Torr for growing a hydrogenated amorphous carbon surface protecting layer on the aluminum substrate with the intrinsic hydrogenated amorphous silicon charge generation transport layer.

2. The method for manufacturing a xerographic photoreceptor device primarily formed by a hydrogenated amorphous silicon material, wherein the $Al_2O_3$ oxidization layer is placed between the conductive aluminum substrate and the n type hydrogenated amorphous silicon charge blocking layer, the time period for baking is ranged from 40 minutes to 50 minutes for growing the $Al_2O_3$ oxidation layer with a thickness of 20~30 Å.

3. The method for manufacturing a xerographic photoreceptor device primarily formed by a hydrogenated amorphous silicon material, wherein the n type hydrogenated amorphous silicon blocking layer is placed between the $Al_2O_3$ oxidation layer and the intrinsic hydrogenated amorphous silicon charge generation transport layer, the time period for deposition is 5 minutes for growing an blocking layer with a thickness of 300~400 Å.

4. The method for manufacturing a xerographic photoreceptor device primarily formed by a hydrogenated amorphous silicon material, wherein the intrinsic hydrogenated amorphous silicon charge generation transport layer is placed between the n type hydrogenated amorphous silicon blocking layer and the hydrogenated amorphous carbon surface protecting layer, the time period for deposition is 7 hours for growing a charge generation transport layer with a thickness of 15~16 $\mu$m.

5. The method for manufacturing a xerographic photoreceptor primarily formed by a hydrogenated amorphous silicon material, wherein the hydrogenated amorphous carbon surface protecting layer is deposited above the intrinsic hydrogenated amorphous silicon charge generation transport layer, the time period for deposition is 20 minutes for growing a surface protecting layer with a thickness of 300~400 Å.

6. The method for manufacturing a xerographic photoreceptor primarily formed by a hydrogenated amorphous silicon hydrogen material, wherein in step b of claim 1, the mixing gas is $SiH_4/H_2$=10% , 100 sccm; $pH_3$=3% ,10 sccm.

7. The method for manufacturing a xerographic photoreceptor primarily formed by a hydrogenated amorphous silicon material, wherein in step c of claim 1, the mixing gas is $SiH_4/H_2$=10% , 150 sccm.

8. The method for manufacturing a xerographic photoreceptor device primarily formed by a hydrogenated amorphous silicon material, wherein in step d of claim 1, the mixing gas is $CH_4/H_2$=30% , 100 sccm.

9. A photosensitive xerographic photoreceptor comprising an aluminum substrate having thereon in sequence a layer of aluminum oxide, an n-type hydrogenated amorphous silicon layer, a charge generation transport layer comprising intrinsic hydrogenated amorphous silicon and a hydrogenated amorphous carbon surface protecting layer.

10. The photoreceptor of claim 9, wherein the aluminum oxide layer has a thickness of from 20 to about 30 Angstroms, the n-type hydrogenated amorphous silicon layer has a thickness of from 300 to about 400 Angstroms, the charge generation transport layer comprising intrinsic hydrogenated amorphous silicon has a thickness of about 15 to about 16 $\mu$m and the hydrogenated amorphous carbon surface protecting layer has a thickness of 300 to about 400 Angstroms.

* * * * *